US010897928B2

(12) United States Patent
Zhou et al.

(10) Patent No.: US 10,897,928 B2
(45) Date of Patent: Jan. 26, 2021

(54) SHAPED ELEMENTS FOR SMOKING DEVICES

(71) Applicant: Essentra Filter Products Development Co Pte Ltd., Singapore (SG)

(72) Inventors: Qiang Zhou, Moseley, VA (US); David B. Harris, Midlothian, VA (US); Thomas E. Harris, Colonial Heights, VA (US); Tom Beaudet, Prince George, VA (US)

(73) Assignee: Essentra Filter Products Development Co Pte. Ltd., Singapore (SG)

( * ) Notice: Subject to any disclaimer, the term of this patent is extended or adjusted under 35 U.S.C. 154(b) by 144 days.

(21) Appl. No.: 15/197,492

(22) Filed: Jun. 29, 2016

(65) Prior Publication Data

US 2018/0000153 A1 Jan. 4, 2018

(51) Int. Cl.

| | |
|---|---|
| ***A24D 3/18*** | (2006.01) |
| ***A24D 3/04*** | (2006.01) |
| ***A24D 3/08*** | (2006.01) |
| ***A24D 3/06*** | (2006.01) |
| ***A24D 3/16*** | (2006.01) |
| *A24D 3/02* | (2006.01) |

(52) U.S. Cl.

CPC ..... *A24D 3/18* (2013.01); *A24D 3/04* (2013.01); *A24D 3/061* (2013.01); *A24D 3/065* (2013.01); *A24D 3/08* (2013.01); *A24D 3/163* (2013.01); *A24D 3/0291* (2013.01)

(58) Field of Classification Search

CPC ..... A24D 3/18

See application file for complete search history.

(56) References Cited

U.S. PATENT DOCUMENTS 3,939,849 A * 2/1976 Baxter ..... A24D 3/08 131/332

5,009,239 A * 4/1991 Cohen ..... A24D 3/14 131/332

(Continued)

FOREIGN PATENT DOCUMENTS

EP 2910134 A1 8/2015

GB 2347607 A 9/2000

(Continued)

OTHER PUBLICATIONS

International Search Report and Written Opinion issued in International Application No. PCT/EP2017/066212, dated Oct. 4, 2017, 13 pages.

*Primary Examiner* — Cynthia Szewczyk

(74) *Attorney, Agent, or Firm* — Sheppard Mullin Richter & Hampton LLP

(57) ABSTRACT

A mouthpiece for a smoking device is provided. The mouthpiece comprises a porous substrate. The porous surface comprises a wall having an outer surface having an outer cross-sectional shape and an inner surface having an inner cross-sectional shape. The inner surface defines a hollow interior space. A wall thickness is defined by the outer and inner surfaces. The porous substrate has a specific hardness of at least about 1.5 hardness % per weight (g) per length (mm) of the porous substrate. The porous substrate has a porosity of about 50% to about 70%. The inner and outer surfaces provide a wall thickness of about 20% to 60% of an area defined by the outer cross-sectional shape.

26 Claims, 4 Drawing Sheets

(56) References Cited

U.S. PATENT DOCUMENTS

| | | | | |
|---|---|---|---|---|
| 5,019,262 | A * | 5/1991 | Wang | A24D 3/08 131/332 |
| 2007/0207186 | A1 * | 9/2007 | Scanlon | A61F 2/91 424/424 |
| 2010/0059073 | A1 * | 3/2010 | Hoffmann | A24F 47/002 131/274 |

FOREIGN PATENT DOCUMENTS

| | | | | |
|---|---|---|---|---|
| GB | 2347607 | B | 9/2000 | |
| GB | 2528243 | A | 1/2016 | |
| WO | 2013034652 | A1 | 3/2013 | |
| WO | WO-2014020055 | A1 * | 2/2014 | A24D 3/043 |
| WO | 2014064087 | A1 | 5/2014 | |

* cited by examiner

FIG. 3A
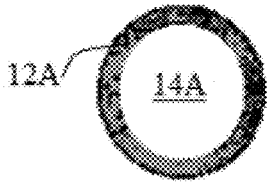
FIG. 3B
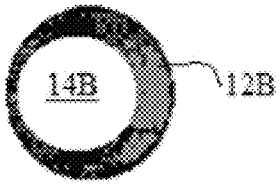
FIG. 3C
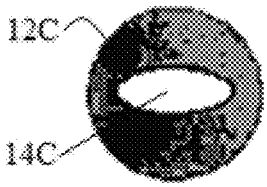
FIG. 3D
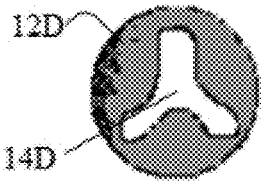
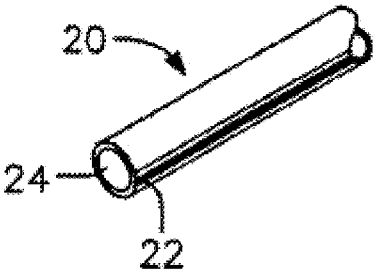
FIG. 4
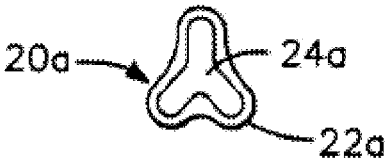
FIG. 5

FIG. 6A
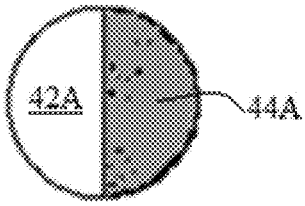
FIG. 6B
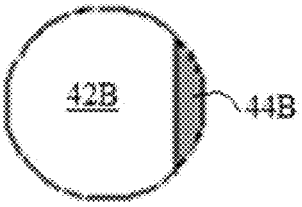
FIG. 6C
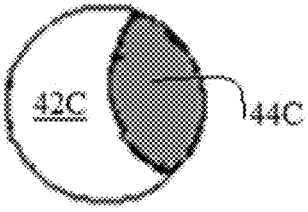
60
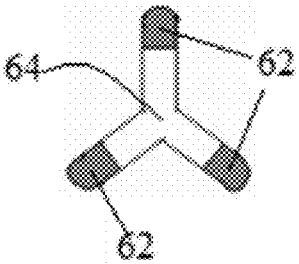
FIG. 7

SHAPED ELEMENTS FOR SMOKING DEVICES

FIELD OF THE INVENTION

This invention relates to porous shaped elements and, more particularly, to mouthpieces for smoking articles.

BACKGROUND

There is a vast diversity of smoking devices that can be used to smoke tobacco and other products. Nearly all smoking devices are provided with a mouthpiece, whether integrated or separable, that a person may place between his or her lips. The shape of the mouthpiece may vary depending on the intended use or preference. The purpose of the tip is to enable a person to inhale or smoke the product along most of the length of the smoking device.

Competition among tobacco companies is rapidly intensifying and thus innovation and differentiation among competitors is becoming ever more important. Specialty filters is one area where tobacco companies may be able to distinguish themselves from one another. There is therefore a need to develop novel mouthpieces and filters for smoking devices that can be easily having a range of desired physical and chemical characteristics and which can be differentiated from those of competitive mouthpieces and filters.

BRIEF SUMMARY

In one embodiment, a shaped element may be provided. The shaped element comprises a wall comprising external and internal surfaces. The external surface has an outer cross-sectional shape and the internal surface has an internal cross-sectional shape. An interior space may be defined by the internal surface. A wall thickness may be defined by the external and internal surfaces. The shaped element has a specific hardness of at least about 1.5 hardness % per weight (g) per length (mm) of the shaped element.

In an optional aspect, the outer cross-sectional shape may be selected from the group consisting of: a closed curve, a polygon, and an abstract shape.

In an optional aspect, the internal cross-sectional shape may be selected from the group consisting of: a closed curve, a polygon, and an abstract shape.

In an optional aspect, the outer and internal cross-sectional shapes may be the same.

In an optional aspect, the outer and internal cross-sectional shapes may be different.

In an optional aspect, the specific hardness may be at least about 1.6 hardness % per weight (g) per length (mm) of the shaped element.

In an optional aspect, the wall thickness may be from about 20% to about 60% of an area defined by the outer cross-sectional shape.

In an optional aspect, the external and internal surfaces and the area therebetween may comprise a porous material.

In an optional aspect, the porous material may have a porosity of about 50% to about 70%.

In another embodiment, a shaped element may be provided. The shaped element may have a porous substrate comprising a wall having external and internal surfaces. An interior space may be defined by the internal surface of the wall of the porous substrate. The porous substrate may have a specific hardness of at least about 1.5 hardness % per weight (g) per length (mm) of the porous substrate.

In an optional aspect, the porous material may have a porosity of about 50% to about 70%.

In an optional aspect, the porous substrate may be made from a web comprised of bicomponent fibers.

In an optional aspect, the bicomponent fibers may comprise two or more polymers having different melting points.

In an optional aspect, a melting point of one of the two or more polymers may be in the range of about 70° C. to about 150° C.

In an optional aspect, the bicomponent fibers may comprise a core and a sheath at least partially surrounding the core. The sheath may be made of a low density polyolefin and the core may be made of a polypropylene.

In an optional aspect, the porous substrate does not comprise cellulose acetate, a plasticizer or both.

In an optional aspect, the wall thickness may be substantially constant. The wall thickness may be in the range of about 0.25 mm to about 1.1 mm.

In an optional aspect, the wall thickness may be variable and may comprise a minimum wall thickness. The minimum wall thickness may be in the range of about 0.25 mm to about 1.1 mm.

In a further embodiment, a cigarette may be provided. The cigarette may comprise any one of the shaped element as previously described.

In an optional aspect, the cigarette may further comprise a filter. The filter may be made of the same material as or of a different material from the shaped element.

In an optional aspect, the cigarette may comprise a further segment disposed adjacent to one or both of the shaped element and the filter. The further segment may be a filter segment or a cavity.

In an optional aspect, the further segment may be a filter segment comprising activated carbon, charcoal or at least one capsule that may comprise a flavorant.

In an optional aspect, the further segment may be a filter segment made of a material different from one or both of the shaped element and the filter.

In an optional aspect, the further segment may be a cavity and the cavity may comprise activated carbon, charcoal or at least one capsule that may comprise a flavorant.

In an optional aspect, the cigarette may further comprise a wrapper disposed around at least the shaped element.

In an optional aspect, the wrapper may be made of a plugwrap paper. The wrapper may comprise a hydrophobic coating.

In a yet a further embodiment, a mouthpiece for a smoking device may be provided. The mouthpiece may comprise a porous substrate comprising a wall. The wall may comprise an outer surface having an outer cross-sectional shape and an inner surface having an inner cross-sectional shape. The inner surface may define a hollow interior space. A wall thickness may be defined by the outer and inner surfaces. The porous substrate may have a specific hardness of at least about 1.5 hardness % per weight (g) per length (mm) of the porous substrate. The porous substrate may have a porosity of about 50% to about 70%. The inner and outer surfaces may provide a wall thickness of about 20% to 60% of an area defined by the outer cross-sectional shape.

In an optional aspect, the outer cross-sectional shape may be a circle and the inner cross-sectional shape may be selected from the group consisting of: a closed curve, a polygon, and an abstract shape.

In an optional aspect, the outer surface may be shaped as a straight cylinder.

In an optional aspect, the hollow interior space may be a cylindrical channel that extends between the first and second ends.

In an optional aspect, the wall thickness may be substantially constant across the outer cross-sectional shape or across a length of the porous substrate.

In an optional aspect, the wall thickness may be variable across the outer cross-sectional shape or across a length of the porous substrate and may comprise a minimum wall thickness.

In an optional aspect, the wall thickness may be in the range of about 0.25 mm to about 1.1 mm.

In an optional aspect, the minimum wall thickness may be in the range of about 0.25 mm to about 1.1 mm.

In an optional aspect, the mouthpiece may further comprise a wrapper covering the outer surface.

In yet a further embodiment, a cigarette may be provided. The cigarette may comprise any one of the mouthpieces as previously described.

In an optional aspect, the cigarette may further comprise a filter. The filter may be made of the same material as the mouthpiece. Alternatively, the filter may be made of a different material as the mouthpiece.

In an optional aspect, the cigarette may further comprise a further segment disposed adjacent to one or both of the shaped element and the filter. The further segment may be a filter segment or a cavity.

In an optional aspect, the further segment may be the filter segment comprising activated carbon, charcoal or at least one capsule that may comprise a flavorant.

In an optional aspect, the further segment may be the filter segment made of a material different from one or both of the shaped element and the filter.

In an optional aspect, the further segment may be the cavity. The cavity may comprise activated carbon, charcoal or at least one capsule that may comprise a flavorant.

In an optional aspect, the cigarette may further comprise a wrapper disposed around at least the shaped element.

In an optional aspect, the wrapper may be made of a plugwrap paper.

In an optional aspect, the wrapper may comprise a hydrophobic coating.

It is understood that each of the above-described aspects are separately provided and may also be provided in various combinations with one another, including such combinations not specifically described. Other objects, features and advantages of the described embodiments will become apparent to those skilled in the art from the following detailed description. It is to be understood, however, that the detailed description and specific examples, while indicating embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Illustrative embodiments of the present disclosure are described herein with reference to the accompanying drawings, in which:

FIGS. 3A-3D depict end elevation views of various configurations of sheath-core bicomponent fibers.

FIG. 4 is a perspective view of one form of a sheath-core bicomponent fiber.

FIG. 5 is an end elevation view of a tri-lobal or "Y" shaped bicomponent fiber.

FIGS. 6A-6C depict end elevation views of side-by-side bicomponent fibers of various different configurations.

FIG. 7 depicts an end elevation view of a tipped multi-lobal bicomponent fiber.

Like numerals refer to like parts throughout the several views of the drawings.

DETAILED DESCRIPTION OF THE EXEMPLARY EMBODIMENTS

Specific, non-limiting embodiments of the present invention will now be described with reference to the drawings. It should be understood that such embodiments are by way of example and are merely illustrative of but a small number of embodiments within the scope of the present invention. Various changes and modifications obvious to one skilled in the art to which the present invention pertains are deemed to be within the spirit, scope and contemplation of the present invention as further defined in the appended claims.

The shaped elements described herein may be configured in any variety of shapes and adapted for a variety of smoking devices, including cigarettes, cigars, cigarillos, and the like. U.S. Patent Appl. Pub. No. 2015/0272207 describing various tips for a smoking article such as a cigar or cigarillo, is incorporated herein by reference as if fully set forth herein. While the exemplary embodiments described herein describe the shaped element as having a cylindrically-shaped outer surface with a hollow channel or internal cavity disposed therewithin, shown in FIGS. 1A and 1B as a concentric cylindrically-shaped channel, it is understood that either one or both of the outer surface and the hollow channel of the shaped element may take on any number of different geometries and shapes, such as a polygonal, curved line or abstract shapes. The abstract shapes may be an enclosed shape that includes one or a combination of straight and curved lines, such as a heart, and may be symmetrical along at least one axis or completely asymmetrical (e.g. having no axis of symmetry). FIGS. 2A to 2B illustrate some examples of various different shapes for the hollow channel or internal cavity that may be employed in accordance with the invention. Starting with the desired geometry and wall thickness of the shaped element, the appropriate weight, density and hardness of the material of the shaped element may be determined.

Figure 1A:
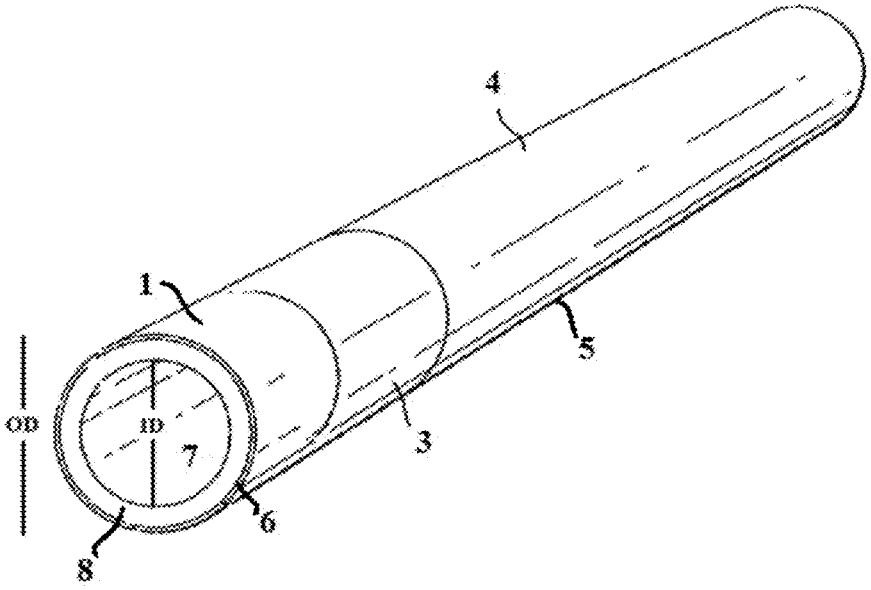
FIGS. 1A-1B depict embodiments of segmented filtered cigarettes, each comprising a cylindrically-shaped tube that may be specifically adapted as a mouthpiece.
Figure 1B:
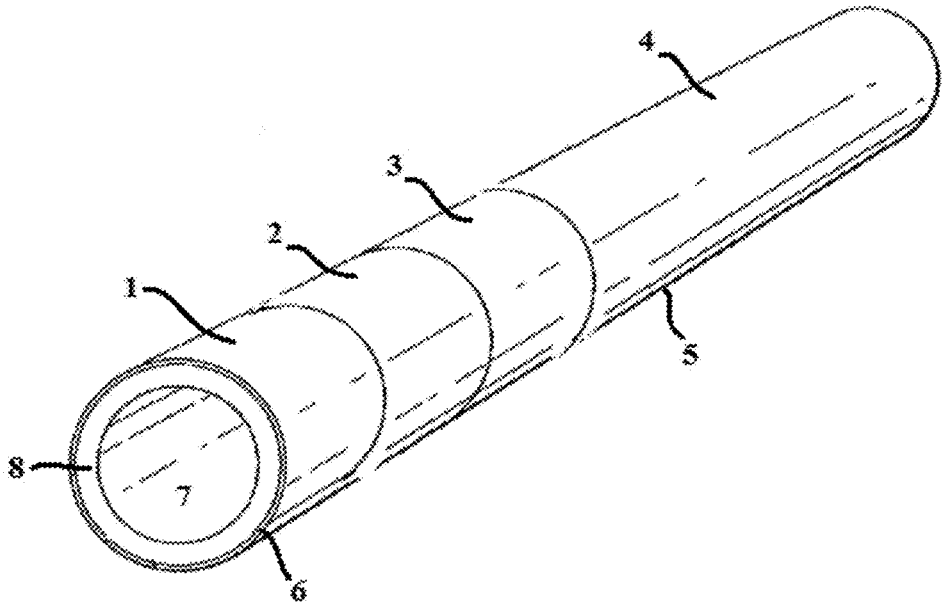
Figure 2A:
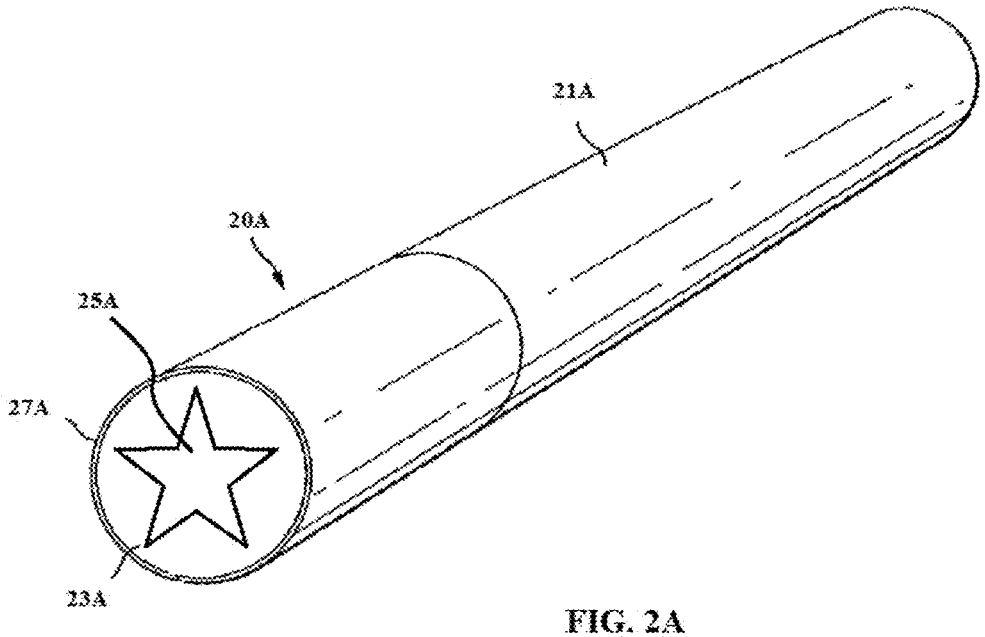
FIGS. 2A-2B depict alternative embodiments of a cylindrically-shaped tube that comprises variously shaped interior channels.
Figure 2B:
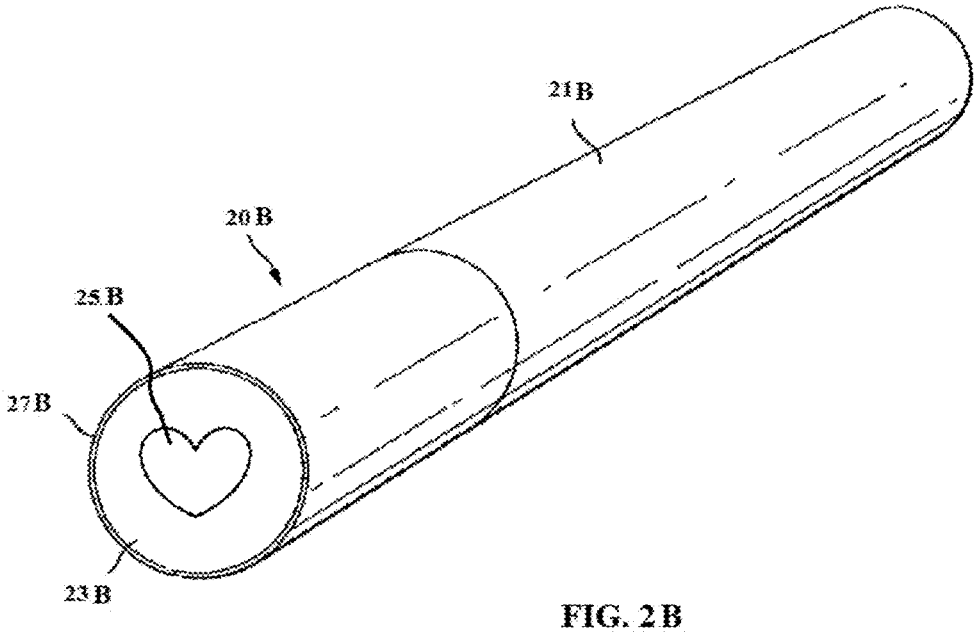

FIGS. 1A and 1B depict exemplary embodiments of the shaped element 1 being provided in connection with a cigarette. In the exemplary embodiment depicted in FIG. 1A, the cigarette may comprise the shaped element 1 at one end of the cigarette and a tobacco column 4 at the other end of the cigarette. A filter 3 may be provided between the shaped element 1 and the tobacco column 4. The filter 3 may be made of the same material as the shaped element 1 (as described in further detail below) or it may be made of a different material, such as cellulose acetate. In the alternative exemplary embodiment depicted in FIG. 1B, the cigarette may have multiple segments comprising, in addition to the shaped element 1 and the tobacco column 4, a further segment 2. The segment 2 may be a filter segment having different material, mechanical, or chemical properties from either one or both of the shaped element 1 and the filter 3. The further segment 2 may also be an empty cavity or a filter or cavity that comprises activated carbon, charcoal, one or a plurality of capsules or microcapsules comprising, for example, a desired flavorant, or a combination of any of the foregoing. The capsules or microcapsules may be frangible such that the application of pressure may release the contents to provide an aroma or flavor. While FIG. 1B depicts the shaped element 1, segment 2 and filter 3 in a particular order, it is understood that the segment 2 and filter 3 may be provided in a different order, with the filter 3 being adjacent to the shaped element 1 and the segment 2 begin adjacent to the tobacco column 4.

The shaped element 1 is depicted in FIGS. 1A and 1B as being a cylindrically-shaped tube having an outer surface 6 defining an outer diameter (OD) and an inner surface 7 having an inner diameter (ID) and defining a hollow cylindrical cavity. A wall thickness 8 may be provided between the outer surface 6 and the inner surface 7. It is understood that the outer surface 6, the inner surface 7 or both the outer and inner surfaces 6, 7 may take on any number of different shapes. It is also understood that shaped element 1 may have a substantially constant wall thickness 8, as depicted in FIGS. 1A and 1B, or a variable wall thickness 8 as depicted in FIGS. 2A and 2B. As used herein, the term "substantially constant" may mean that the variation does not exceed about 1%, about 3%, about 5%, about 7%, about 10%, about 15%, about 20% or about 25% of the stated value. As used herein, the term "variable" may mean that the variation exceeds about 1%, about 3%, about 5%, about 7%, about 10%, about 15%, about 20% or about 25% of the stated value. For a cylindrically-shaped tube having a centrally-disposed hollow channel, as depicted in FIGS. 1A and 1B, the wall thickness 13 can be calculated as the difference between the diameters of the external surface and the internal surface divided by two. For embodiments in which the wall thickness is variable from a minimum thickness (e.g., between the outer surface and the outwardly pointing apices or points on the star of the inner surface in FIG. 2A) to a maximum thickness (e.g., between the outer surface and the points directed radially inwardly of the outer surface in FIG. 2A), the thickness can be represented as a % thickness over the entire cross-sectional area defined by the outer surface or the thickness can be provided as a range of minimum and maximum thicknesses. In the case of the latter, the thickness determination can be made by direct measurement or by calculation based on the geometry presented by the outer and inner surfaces.

A wrapper 5 may be engaged around the entire outer surface of the cigarette, as depicted in FIGS. 1A and 1B, or around at least a portion of the cigarette, such as, for example, at least the shaped element 1, the further segment 2, the filter 3, the tobacco column 4, or any combination of the foregoing. The wrapper 5 may be a plugwrap paper and may be printed, coated, porous or partially porous, or any combination of the foregoing. In one embodiment, the wrapper 5 may have a hydrophobic coating to prevent or reduce the incidence of the smoker's lips from sticking to it. In embodiments where the wrapper may be a paper, the basis weight of the wrapper may be about 30 g/m$^2$, about 35 g/m$^2$, about 40 g/m$^2$, about 45 g/m$^2$, about 50 g/m$^2$, about 55 g/m$^2$, about 60 g/m$^2$, about 65 g/m$^2$, about 70 g/m$^2$, about 75 g/m$^2$, about 80 g/m$^2$, about 85 g/m$^2$, about 90 g/m$^2$, about 95 g/m$^2$, about 100 g/m$^2$, about 105 g/m$^2$, about 110 g/m$^2$, about 115 g/m$^2$, or about 120 g/m$^2$. The basis weight may also be provided within a range including and between any two of the foregoing values. It is understood that the wrapper may be flush or substantially flush with the end of the shaped element, as depicted in FIGS. 1-2. In another embodiment, the wrapper may extend beyond the end of the shaped element.

FIGS. 2A and 2B depict embodiments of the shaped element having variously shaped internal cavities. FIG. 2A shows a cylindrically-shaped element 20A having an outer surface and an internal surface defining an interior space 25A that is shaped as a star. As a result of this shape, it is understood that the wall thickness 23A may be variable along the cross-section. FIG. 2B shows another embodiment in which the cylindrically-shaped element 20B has an interior surface that defines an interior space 25B that is shaped as a heart. Again, the wall thickness 23B is variable along the cross-section and a wrapper 27B may be provided around the shaped element 20B and the tobacco column 21B. In both FIGS. 2A and 2B, wrappers 27A, 27B are also provided around the entire outer surface of the shaped elements 20A, 20B and the tobacco column 21A, 21B to join the two portions together. While not depicted in FIGS. 2A and 2B, it is understood that FIGS. 2A and 2B may further comprise a filter segment and a further segment as described in relation to FIGS. 1A and 1B.

Regardless of the configuration of the shaped element, as depicted in the exemplary embodiments of FIGS. 1-2, the shaped element may have a wall thickness (e.g., FIGS. 1A and 1B) or a minimum wall thickness (e.g., smallest value for wall thickness across a variable wall thickness cross-section FIGS. 2A and 2B) of about 0.10 mm or less, about 0.15 mm or less, about 0.20 mm or less, about 0.25 mm or less, about 0.30 mm or less, about 0.35 mm or less, about 0.40 mm or less, about 0.45 mm or less, about 0.50 mm or less, about 0.55 mm or less, about 0.60 mm or less, about 0.65 mm or less, about 0.70 mm or less, about 0.75 mm or less, about 0.80 mm or less, about 0.85 mm or less, about 0.90 mm or less, about 0.95 mm or less, about 1.00 mm or less, about 1.05 mm or less, about 1.10 mm or less, about 1.15 mm or less, about 1.20 mm or less, about 1.25 mm or less, about 1.30 mm or less, about 1.35 mm or less, about 1.40 mm or less, about 1.45 mm or less, about 1.50 mm or less, about 1.55 mm or less, about 1.60 mm or less, about 1.65 mm or less, about 1.70 mm or less, about 1.75 mm or less, about 1.80 mm or less, about 1.85 mm or less, about 1.90 mm or less, about 1.95 mm or less, or about 2.00 mm or less. The shaped element may also have a wall thickness within a range including and between any two of the foregoing values.

Alternatively, the wall thickness of the shaped element may be represented by the wall thickness %, which is the percentage of the wall thickness over an entire cross-sectional area of the shaped element. For example, the wall thickness % for the shaped elements depicted in FIGS. 1A and 1B may be calculated as follows: $(1-(ID^2/OD^2))*100$ wherein ID represents the internal diameter of the cylinder and OD represents the external diameter of the cylinder. It is understood that for other shapes, different calculations will apply and such calculations are readily ascertainable by one of ordinary skill in the art.

In an exemplary embodiment, the wall thickness % may be at least about 20%, at least about 25%, at least about 30%, at least about 35%, at least about 40%, at least about 45%, at least about 50%, at least about 55%, at least about 60%, at least about 65%, at least about 70%, at least about 75%, at least about 80%, at least about 85%, at least about 90%, or at least about 95% of the total cross-sectional area of the shaped element. The wall thickness % may also be within a range including and between any two of the foregoing values. For example, the wall thickness % may be provided in a range including and between 20% and 90% and between 40% and 60%.

Thus, starting with a shaped element having a given geometry for its inner and outer wall surfaces and wall thickness or wall thickness %, the required density and hardness of the shaped element can be ascertained. The density of the shaped element may be derived from the weight and volume occupied by the shaped element. It is understood that a greater density may be required as the wall thickness or the wall thickness % decreases. Where the wall thickness is variable along the cross-section, it may be desirable to calculate the required density and hardness based on the smallest value of the wall thickness (e.g. minimum wall thickness) along the cross-section so as to ensure that the dimensional definition may be maintained at the thinnest section of the wall.

In an exemplary embodiment, the density, while dependent on the geometry and wall thickness, may be about 0.50 $g/cm^3$ or less, about 0.45 $g/cm^3$ or less, about 0.40 $g/cm^3$ or less, about 0.35 $g/cm^3$ or less, about 0.30 $g/cm^3$ or less, about 0.25 $g/cm^3$ or less, about 0.20 $g/cm^3$ or less, about 0.15 $g/cm^3$ or less, or about 0.10 $g/cm^3$ or less. The density may also be within a range including and between any two of the foregoing values.

In one embodiment, the wall thickness % may be provided in the range of from about 40% to about 60% and the density may be about 0.35 $g/cm^3$ or less or, alternatively, in a range from about 0.20 $g/cm^3$ to about 0.35 $g/cm^3$. In another embodiment, the wall thickness % may be provided in the range of from about 30% to about 40% and the density may be about 0.50 $g/cm^3$ or less or, alternatively, within a range from about 0.20 $g/cm^3$ to about 0.50 $g/cm^3$.

It is also understood that a greater density may be required to achieve a higher level of hardness. There are two measures of hardness: hardness % and specific hardness.

In one embodiment, the hardness % of the shaped element may be about 75% or greater, about 80% or greater, about 85% or greater, about 90% or greater, about 95% or greater, about 96% or greater, about 97% or greater, about 98% or greater, about 99% or greater or about 100% or greater. The hardness % may also be within a range including and between any two of the foregoing values. In a specific embodiment, the smaller the wall thickness of the shaped element, the greater the hardness %. In one embodiment, the hardness % of the shaped element may be inversely proportional to the wall thickness or minimum wall thickness.

The hardness % of a given shaped element may be obtained by direct measurement and, as provided herein, may be measured by a Borgwaldt Hardness Tester H10 instrument (Borgwaldt KC Inc., Richmond, Va.) based on the following calculation:

$$\text{Hardness } \% = (h_1/h_0)*100$$

wherein $h_0$ is the original diameter or width of the shaped element and $h_1$ is the diameter or width of the shaped element under a compressive load of about 150 g. In the example of the cylindrically-shaped tube, the compressive load is applied on the cylindrical wall and in a direction radially towards the center of the tube.

In an exemplary embodiment, the shaped element may have a wall thickness of from about 30% to about 60%, a density in range from about 0.20 $g/cm^3$ to about 0.35 $g/cm^3$, and a hardness % may be in the range of about 80% to about 98%.

The specific hardness represents the amount of material required to produce the hardness in %/weight (g)/length (mm) of the shaped element and thus may be a value derived from hardness %, weight (g) and length (mm) of the shaped element.

In an exemplary embodiment, the specific hardness may be at least about 1.40%/g/mm, at least about 1.45%/g/mm, at least about 1.50%/g/mm, at least about 1.55%/g/mm, at least about 1.60%/g/mm, at least about 1.65%/g/mm, at least about 1.70%/g/mm, at least about 1.75%/g/mm, at least about 1.80%/g/mm, at least about 1.85%/g/mm, at least about 1.90%/g/mm, at least about 1.95%/g/mm, at least about 2.00%/g/mm, at least about 2.05%/g/mm, at least about 2.10%/g/mm, at least about 2.15%/g/mm, at least about 2.20%/g/mm, at least about 2.25%/g/mm, at least about 2.30%/g/mm, at least about 2.35%/g/mm, at least about 2.40%/g/mm, at least about 2.45%/g/mm, or at least about 2.50%/g/mm. The specific hardness may also be within a range including and between any two of the foregoing values.

In an exemplary embodiment, the shaped element may be a cylindrically-shaped tube that may be used as a mouthpiece for a smoking device. The length of the cylindrically-shaped tube may be at least about 3 mm, at least about 5 mm, at least about 7 mm, at least about 10 mm, at least about 12 mm, at least about 15 mm, at least about 17 mm, at least about 20 mm, at least about 22 mm, at least about 25 mm, at least about 27 mm, at least about 30 mm, at least about 35 mm, at least about 40 mm, at least about 45 mm, at least about 50 mm, at least about 55 mm, at least about 60 mm, at least about 65 mm, at least about 70 mm, at least about 75 mm, at least about 80 mm, at least about 85 mm, at least about 90 mm, at least about 95 mm, at least about 100 mm, at least about 105 mm, at least about 110 mm, at least about 115 mm, at least about 120 mm, or at least about 125 mm. The length may also be within a range including and between any two of the foregoing values.

In the exemplary embodiment of the cylindrically-shaped tube used as a mouthpiece for the smoking device, the outer diameter may be at least about 3 mm, at least about 3.5 mm, at least about 4 mm, at least about 4.5 mm, at least about 5 mm, at least about 5.5 mm, at least about 6 mm, at least about 6.5 mm, at least about 7 mm, at least about 7.5 mm, at least about 8 mm, at least about 8.5 mm, at least about 9 mm, at least about 9.5 mm, at least about 10 mm, at least about 10.5 mm, at least about 11 mm, at least about 11.5 mm, at least about 12 mm, at least about 12.5 mm, at least about 13 mm, at least about 13.5 mm, at least about 14 mm, at least about 14.5 mm, at least about 15 mm, at least about 15.5 mm, at least about 16 mm, at least about 16.5 mm, at least about 17 mm, at least about 17.5 mm, at least about 18 mm, at least about 18.5 mm, at least about 19 mm, at least about 19.5 mm, at least about 20 mm, or at least about 20.5 mm. The outer diameter may also be within a range including and between any two of the foregoing values.

In the exemplary embodiment of the cylindrically-shaped tube used as a mouthpiece for the smoking device, the inner diameter may be at least about 1 mm, at least about 1.5 mm, at least about 2 mm, at least about 2.5 mm, at least about 3 mm, at least about 3.5 mm, at least about 4 mm, at least about 4.5 mm, at least about 5 mm, at least about 5.5 mm, at least about 6 mm, at least about 6.5 mm, at least about 7 mm, at least about 7.5 mm, at least about 8 mm, at least about 8.5 mm, at least about 9 mm, at least about 9.5 mm, or at least about 10 mm. The inner diameter may also be within a range including and between any two of the foregoing values.

It is understood that each of the foregoing values may be provided in any combination of one another to form the mouthpiece.

The shaped element may be formed from a porous substrate of bicomponent fibers. The bicomponent fibers may be made from a melt-blown process using a high pressure gas stream at the exit of a fiber extrusion die to attenuate or thin out fibers while they are in their molten state. U.S. Pat. Nos. 3,595,245, 3,615,995 and 3,972,759 disclose such a melt blowing process and U.S. Pat. Nos. 4,795,668 and 5,607,766 disclose exemplary melt blowing of bicomponent fibers. Each of the foregoing patents are incorporated herein by reference in their entireties as if fully set forth herein.

The bicomponent fibers may comprise two or more distinct components or polymer systems having different chemical properties placed in discrete portions of a fiber structure. Different configurations of the two polymer systems in bicomponent fibers are possible, including sheath-core, side-by-side, segmented pie, segmented cross, sheath-core multi-lobal, and tipped multi-lobal configurations. FIGS. 3-7 depict various exemplary configurations for the bicomponent fibers. In one embodiment, the two or more distinct components may be made of different thermoplastic polymers. The thermoplastic polymers may comprise polyolefins, such as polyethylene, low density polyethylene and polypropylene; polyesters, such as polyethylene terephthalate; polylactic acid (PLA); polyvinyl alcohol (PVA); ethylene vinyl acetate (EVA); or any combinations of the foregoing. It is understood that bicomponent fibers comprising any two of the foregoing thermoplastic polymers as sheath and core may be provided.

In a specific embodiment, at least one of the thermoplastic polymers has a melting point of about 150° C. or less, about 145° C. or less, about 140° C. or less, about 135° C. or less, about 130° C. or less, about 125° C. or less, about 120° C. or less, about 115° C. or less, about 110° C. or less, about 105° C. or less, about 100° C. or less, about 95° C. or less, about 90° C. or less, about 85° C. or less, about 80° C. or less, about 75° C. or less, or about 70° C. or less. The melting point may also be within a range including and between any two of the foregoing values. In a bicomponent fiber, the two polymer systems may have different melting points, with the polymer system having the lower melting point comprising the exposed surface. For example, in a sheath-core bicomponent fiber, the sheath may have a lower melting point than the core. In an alternative embodiment of the bicomponent fiber, the core may have a lower melting point than the sheath.

In one embodiment, the bicomponent fibers are sheath-core fibers comprising 50% by weight polypropylene and 50% by weight low density polyethylene. In accordance with a first aspect, the sheath may be formed from the low density polyethylene and the core may be formed from the polypropylene. In accordance with a second aspect, the sheath may be formed from the polypropylene and the core may be formed from the low density polyethylene.

FIGS. 3-7 depict the various exemplary configurations of bicomponent fibers. It is understood that the relative proportions of the bicomponent fibers are not drawn to scale and that they are depicted merely to show the relative spatial relationship between the two portions of the bicomponent fibers.

FIGS. 3-7 depict various configurations of a sheath-core bicomponent fiber. The size of the fiber and the relative proportions of the sheath and core portions have been exaggerated for illustrative clarity. FIGS. 3A-3E depict bicomponent fibers having five different exemplary sheath-core configurations comprising a core of various shapes and positions (14A-14E) that may be completely surrounded by a sheath (12A-12E). FIG. 4 depicts a bicomponent sheath-core fiber 20 with a core 25 that may be entirely surrounded by a sheath 22. In one specific embodiment, the volume of the core may be about 50 to about 80% of the total volume of the sheath-core bicomponent fiber and the volume of the sheath may be about 20-50% of the total volume of the sheath-core bicomponent fiber. In another exemplary embodiment, the volume of the core may be about 60-80% of the total volume of the sheath-core bicomponent fiber and the volume of the sheath may be about 20-40% of the total volume of the sheath-core bicomponent fiber. In a further exemplary embodiment, the volume of the core may be about 70-85% of the total volume of the sheath-core bicomponent fiber and the volume of the sheath comprises 15-30% of the total volume of the sheath-core bicomponent fiber.

It is observed that in each of the embodiments depicted in FIGS. 3-4, the outer surface of the fiber may be substantially cylindrical. It is understood, however, that the outer surface of the bicomponent fibers are not so limited to assume a cylindrical shape and that other outer surface shapes are possible. For example, a multi-lobal shape may be provided, as depicted in FIG. 5. The bicomponent fiber of FIG. 5, more specifically, is a tri-lobal or "Y" shaped fiber 20*a* comprising a sheath 22*a* and a core 24*a*. Regardless of the shape, the sheath of this embodiment may comprise a homo- or co-polymer of poly(m-xylene adipamide) or polyphenylene sulfide which may entirely surround the core material of a thermoplastic homo- or co-polymer.

FIGS. 6A-6C depict another embodiment of bicomponent fibers which may be used to produce the webs, rovings or self-supporting, three-dimensional porous elements disclosed herein. The bicomponent fibers FIGS. 6A-6C may be variations of the side-by-side configuration in which each of the two polymer systems are exposed. In one embodiment, the first fiber portion (42A-C) may comprise a first thermoplastic polymeric material and the second fiber portion (44A-C) may comprise a different thermoplastic polymeric material. The first and second thermoplastic polymeric material may be characterized as having different melting points.

The main difference between the two foregoing embodiments is the relative proportion or volume of the two fiber portions in FIGS. 6A-6C and thus the relative proportions of the two different polymer systems. In the bicomponent fiber FIG. 6A, the volume of the first and second portions, and thus the two polymer systems, are substantially equal.

In the bicomponent fiber of FIGS. 6B and 6C, the two embodiments reflect the varying amounts of the two polymer systems that may be present. In one aspect of the embodiment, the bicomponent fiber of 6B, the volume of the first fiber portion 42B may be about 80 to about 95% of the total volume of the bicomponent fiber and the volume second fiber portion 44B may be about 5-20% of the total volume of the bicomponent fiber.

In the bicomponent fiber of FIG. 6C, the volume of the first fiber portion 42C may be about 65-80% of the total volume of the bicomponent fiber and the volume of the second fiber portion 44C may be about 20-35% of the total volume of the bicomponent fiber.

In one embodiment, the volume of the first fiber portion (42B or 42C) may be about 50-80% of the total volume of the bicomponent fiber and the volume of the second fiber portion (44B or 44C) may be about 20-50% of the total volume of the bicomponent fiber. In another embodiment, the volume of the first fiber portion (42B or 42C) may be about 60-80% of the total volume of the bicomponent fiber and the volume of the second fiber portion (44B or 44C) may be about 20-40% of the total volume of the bicomponent fiber. In a further embodiment, the volume of the first fiber portion (42B or 42C) may be about 70-85% of the total volume of the bicomponent fiber and the volume of the second fiber portion (44B or 44C) may be about 15-30% of the total volume of the sheath-core bicomponent fiber.

FIG. 7 depicts a further embodiment of a tipped multi-lobal bicomponent fiber 60 which may be used to produce the webs, rovings, or self-supporting, three-dimensional porous elements disclosed herein. The multi-lobal bicomponent fiber 60 comprises a plurality of tips 62 and a central body 64. In one embodiment, the tips 62 may comprise homo- or co-polymers a first thermoplastic polymeric material and the central body 64 may comprise a second thermoplastic polymeric material. In one embodiment, the first thermoplastic polymeric material may have a lower melting point (e.g., a low density polyethylene) than the second thermoplastic polymeric material (e.g., polypropylene). In another embodiment, the second thermoplastic polymeric material may have a lower melting point (e.g., a low density polyethylene) than the first thermoplastic polymeric material (e.g., polypropylene).

EXAMPLE

Various shaped elements configured as filter tube rods were prepared to compare the specific hardness that was obtained based on the different weights, densities, hardness %, porosity, and wall thicknesses. The shaped elements had a structure and shape similar to the exemplary embodiment depicted in FIG. 1A and having the weight, length, outer diameter, inner diameter and wall thickness as provided in Table 1. The values provided in Table 1 represent the average values based on ten (10) samples in each identified sample.

Cellulose acetate tow samples were the filter tubes made with a cellulose acetate tow and plasticizer.

Group 1 (X6879B, X6879C and X6978A) represents exemplary embodiments of the shaped element, each having a targeted wall thickness of about 1.33 mm with the samples each having different weights.

Group 2 (X8978C, X6991A, X6991B, and X6991C) represents exemplary embodiments of the shaped element, each having a targeted wall thickness of about 0.83 mm with the samples each having different weights.

The shaped elements in Groups 1 and 2 were made from a non-woven web of thermally bonded, bicomponent fibers. The bicomponent fibers were sheath-core bicomponent fibers having a sheath comprising low density polyethylene and a core of polypropylene. The bicomponent fibers comprised 50% by weight of the low density polyethylene and 50% by weight of the polypropylene. The shaped elements did not comprise any plasticizers.

TABLE 1

Average Values comparing Cellulose Acetate with the Exemplary Embodiments (Groups 1 and 2).

| | Sample | Weight (g) | Length (mm) | OD (mm) | ID (mm) | Density (g/cm$^3$) | Hardness (%) | Porosity (%) | Wall Thickness | Specific Hardness Hardness (Hardness %/g/mm) |
|---|---|---|---|---|---|---|---|---|---|---|
| | Cellulose Acetate Tow | 0.840 | 84.05 | 7.70 | 5.06 | 0.378 | 94.9 | 58.5 | 1.318 mm 56.779% | 1.346 |
| Group 1 | X6879B | 0.584 | 84.00 | 7.59 | 4.92 | 0.265 | 86.0 | 70.8 | 1.336 mm 57.993% | 1.750 |
| | X6879C | 0.679 | 83.74 | 7.59 | 4.92 | 0.309 | 95.6 | 66.0 | 1.334 mm 57.956% | 1.682 |
| | X6978A | 0.647 | 83.97 | 7.65 | 5.02 | 0.295 | 94.8 | 67.6 | 1.314 mm 56.914% | 1.743 |
| Group 2 | X6978C | 0.661 | 83.81 | 7.64 | 5.98 | 0.445 | 95.1 | 51.1 | 0.829 mm 38.699% | 1.716 |
| | X6991A | 0.421 | 84.19 | 7.66 | 6.00 | 0.280 | 81.5 | 69.2 | 0.832 mm 38.731% | 2.312 |
| | X6991B | 0.491 | 84.25 | 7.66 | 5.99 | 0.326 | 89.2 | 64.4 | 0.836 mm 38.915% | 2.172 |
| | X6991C | 0.568 | 84.00 | 7.65 | 5.97 | 0.377 | 90.5 | 58.4 | 0.838 mm 39.013% | 1.892 |

The values for density are derived from the weight and volume of the sample and a higher density may be required as the wall thickness is reduced to maintain the structural integrity of the shaped element.

The values for hardness (%) were obtained by measuring, at three (3) equally-spaced locations along the outer surface of the shaped element. The hardness (%) may be measured using a Borgwaldt H10 instrument and may be based on the following calculations: Hardness %=$(h_1/h_0)*100$, where $h_0$ is the original diameter of the shaped element (depicted as OD in FIG. 1A) and $h_1$ is the diameter of the shaped element under a load of 150 grams.

The values for porosity (%) are calculated based on density and the material solid density as follows: Porosity (%)=$(1-(d_r/d_m))*100$ where $d_r$ may be the density of the shaped element and $d_m$ may be the material density. In other words, $d_r$ represents a bulk density of the shaped element and $d_r$ represents the specific gravity of the material that comprises the shaped element. In one embodiment, the range of porosity may be from about 50% to about 70%, as demonstrated in Table 1. In another embodiment, the range of porosity may be from about 30% to about 90%.

As stated above, the targeted wall thickness may be between about 0.83 mm and about 1.33 mm. It is understood, however, that the wall thickness may be provided of about 0.20 mm or greater. In these examples, wall thickness % may be based on a cross-sectional area defined by the OD. It is understood that while the calculation of the cross-sectional area defined by the OD may be the area of a circle, the area of any geometric shape may be calculated based on other formulas or methods. Thus the wall thickness % represents the percentage of the cross-sectional area occupied by the wall of the entire cross-sectional area bounded by the outer diameter in the case of a circle.

The values for specific hardness are obtained based on the hardness % per weight (g) per length (mm) (%/g/mm). As can be seen from Table 1, the samples in Groups 1 and 2 exhibited surprisingly high specific hardness as compared to the cellulose acetate tow (cellulose acetate+plasticizer) sample. The high specific hardness is believed to impart on the samples in Groups 1 and 2 the desirable characteristics of providing high dimensional definition at a reduced wall thickness and thus at a reduced weight as compared to its cellulose acetate counterpart.

The non-limiting embodiments of the present invention described and claimed herein are not to be limited in scope by the specific embodiments disclosed herein, as these embodiments are intended as illustrations of several aspects of the invention. Indeed, various modifications of the invention in addition to those shown and described herein will become apparent to those skilled in the art from the foregoing description. Such modifications are also intended to fall within the scope of the appended claims.

The invention claimed is:

1. A mouthpiece for a smoking device comprising:

a wall comprising external and internal surfaces, the external surface having an outer cross-sectional shape and the internal surface having an internal cross-sectional shape;

an interior space defined by the internal surface; and a wall thickness defined by the external and internal surfaces;

wherein the mouthpiece for a smoking device has a specific hardness of about 1.5 to about 2.5;

wherein the external and internal surfaces and the area therebetween comprise a porous material.

2. The mouthpiece for a smoking device of claim 1, wherein the outer cross-sectional shape is selected from the group consisting of: a closed curve, a polygon, and an abstract shape.

3. The mouthpiece for a smoking device of claim 1, wherein the internal cross-sectional shape is selected from the group consisting of: a closed curve, a polygon, and an abstract shape.

4. The mouthpiece for a smoking device of claim 1, wherein the outer and internal cross-sectional shapes are the same.

5. The mouthpiece for a smoking device of claim 1, wherein the outer and internal cross-sectional shapes are different.

6. The mouthpiece for a smoking device of claim 1, wherein the specific hardness is from about 1.6 to about 2.5.

7. The mouthpiece for a smoking device of claim 1, wherein the wall thickness is from about 20% to about 60% of an area defined by the outer cross-sectional shape.

8. The mouthpiece for a smoking device of claim 1, wherein the porous substrate does not comprise cellulose acetate, a plasticizer or both.

9. A mouthpiece for a smoking device comprising:

a porous substrate comprising a wall having external and internal surfaces; and an interior space defined by the internal surface of the wall of the porous substrate;

wherein the porous substrate has a specific hardness of about 1.5 to about 2.5.

10. The mouthpiece for a smoking device of claim 9, wherein the porous material has a porosity of about 50% to about 70%.

11. The mouthpiece for a smoking device of claim 9, wherein the porous substrate is made from a web comprised of bicomponent fibers.

12. The mouthpiece for a smoking device of claim 11, wherein the bicomponent fibers comprise two or more polymers having different melting points.

13. The mouthpiece for a smoking device of claim 12, wherein a melting point of one of the two or more polymers is in the range of about 70° C. to about 150° C.

14. The mouthpiece for a smoking device of claim 11, wherein the bicomponent fibers comprise a core and a sheath at least partially surrounding the core;

wherein the sheath is made of a low density polyolefin; and wherein the core is made of a polypropylene.

15. The mouthpiece for a smoking device of claim 14, wherein the wall thickness is in the range of about 0.25 mm to about 1.1 mm.

16. A cigarette comprising:

a shaped element comprising:

a wall comprising external and internal surfaces, the external surface having an outer cross-sectional shape and the internal surface having an internal cross-sectional shape;

an interior space defined by the internal surface; and a wall thickness defined by the external and internal surfaces;

wherein the shaped element has a specific hardness of about 1.5 to about 2.5;

wherein the external and internal surfaces and the area therebetween comprise a porous material.

17. The cigarette of claim 16, further comprising a filter.

18. The cigarette of claim 17, wherein the filter is made of the same material as the shaped element.

19. The cigarette of claim 17, wherein the filter is made of a different material as the shaped element.

20. The cigarette of claim 16, further comprising a further segment disposed adjacent to one or both of the shaped element and the filter.

21. The cigarette of claim 20, wherein the further segment is a segment or a cavity.

22. The cigarette of claim 20, wherein the further segment is a filter segment comprising activated carbon, charcoal or at least one capsule that comprises a flavorant.

23. The cigarette of claim 20, wherein the further segment is a filter segment made of a material different from one or both of the shaped element and the filter.

24. The cigarette of claim 20, wherein the further segment is a cavity and wherein the cavity comprises activated carbon, charcoal or at least one capsule that comprises a flavorant.

25. The cigarette of claim 16 further comprising a wrapper disposed around at least the shaped element.

26. A mouthpiece for a smoking device comprising:

a porous substrate comprising a wall, the wall comprising an outer surface having an outer cross-sectional shape and an inner surface having an inner cross-sectional shape and the inner surface defining a hollow interior space; and a wall thickness defined by the outer and inner surfaces;

wherein the porous substrate has a specific hardness of about 1.5 to about 2.5; and wherein the porous substrate has a porosity of about 50% to about 70%; and wherein the inner and outer surfaces provide a wall thickness of about 20% to 60% of an area defined by the outer cross-sectional shape.

* * * * *